US009412249B2

(12) United States Patent
Smith

(10) Patent No.: US 9,412,249 B2
(45) Date of Patent: Aug. 9, 2016

(54) LOVELY LIFE COSTUME AND DESIGNER JEWELRY FOR EMERGENCY ALERT DEVICES

(71) Applicant: Elizabeth DeLaney Smith, Gainesville, FL (US)

(72) Inventor: Elizabeth DeLaney Smith, Gainesville, FL (US)

( * ) Notice: Subject to any disclaimer, the term of this patent is extended or adjusted under 35 U.S.C. 154(b) by 0 days.

(21) Appl. No.: 14/098,129

(22) Filed: Jan. 17, 2014

(65) Prior Publication Data

US 2015/0203280 A1 Jul. 23, 2015

(51) Int. Cl.

| | |
|---|---|
| ***G08B 21/00*** | (2006.01) |
| ***A44C 25/00*** | (2006.01) |
| ***G08B 21/02*** | (2006.01) |
| ***A44C 15/00*** | (2006.01) |
| ***G08B 25/01*** | (2006.01) |
| *A44C 17/02* | (2006.01) |

(52) U.S. Cl.

CPC ..... *G08B 21/02* (2013.01); *A44C 15/00* (2013.01); *G08B 25/016* (2013.01); *A44C 15/0015* (2013.01); *A44C 17/02* (2013.01); *A44C 25/001* (2013.01)

(58) Field of Classification Search

CPC .... A44C 15/003; A44C 25/00; A44C 25/002; A44C 15/00; A44C 25/016; G06F 1/1628; A45C 2013/025; A45C 13/02; G08B 21/02; G08B 25/016; B65D 85/00; B65D 85/70

USPC ..... 455/100; 63/40; 224/576

See application file for complete search history.

(56) References Cited

U.S. PATENT DOCUMENTS

| | | | | |
|---|---|---|---|---|
| 4,078,660 | A * | 3/1978 | Lerro | 206/530 |
| 7,946,459 | B1 * | 5/2011 | Cheitman | 224/600 |
| 8,651,346 | B1 * | 2/2014 | Williams | 224/222 |
| 2006/0025182 | A1 * | 2/2006 | Tushinsky et al. | 455/575.1 |
| 2009/0321291 | A1 * | 12/2009 | Asla | A45C 11/00 206/320 |
| 2012/0261289 | A1 * | 10/2012 | Wyner | A45C 11/00 206/320 |
| 2014/0366249 | A1 * | 12/2014 | West | 2/244 |

* cited by examiner

*Primary Examiner* — Emily Morgan

(57) ABSTRACT

A variety of styles and designs of ornamental enclosures and/or attachments and distinguished by being constructed with one or more of the following products: durable metals, alloys, plastics, composites, ceramics, enamels, similar materials or other durable products or combinations thereof which may be adorned with precious, semiprecious or costume jewels or other decorations and considered as jewelry and will be adapted to enhance the appearance of monitored common emergency alert devices. A free-floating actuator button in the jewelry would be depressed over an common emergency alert device button summoning assistance. Another embodiment of Lovely Life Jewelry could be made with generic internal emergency alert circuitry to connect with existing or future emergency alert services. The purpose of the designer or costume jewelry is to make emergency alert devices more attractive and, therefore, enhance the health, safety and security of the wearer.

4 Claims, 5 Drawing Sheets

LOVELY LIFE COSTUME AND DESIGNER JEWELRY FOR EMERGENCY ALERT DEVICES

CROSS REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH OR DEVELOPMENT

Not Applicable

BACKGROUND OF THE INVENTION

1. Field of the Invention

Figure 1A:
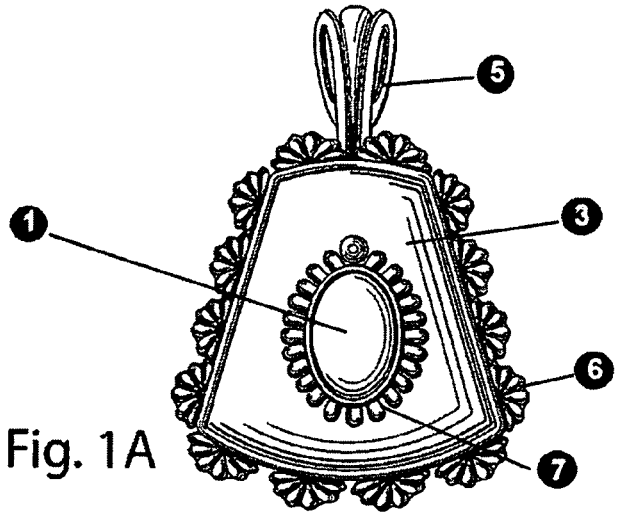

The present invention relates to all types of designs of costume and designer jewelry to accommodate emergency alert devices. The jewelry is an ornamental housing adaptable to all common emergency alert devices. The present invention includes jewelry that could be made with generic internal alert circuitry to connect with existing and future emergency alert services and/or costume or designer jewelry that accommodates existing and future alert devices via encasing, housing or otherwise attaching to emergency alert devices. The jewelry would be made from a variety of durable materials. The jewelry is not made of cloth and it is not clothing but an attractive jewelry accessory. The jewelry transforms an unattractive alert device into a stylish accessory that increases the security and safety of the wearer.

2. Descriptions of Related Art

Millions of people are aging into their retirement years. Many more live alone or are at risk. Their safety and health may be compromised when a great number of them refuse to habitually wear unattractive emergency alert devices. Prior art fails to provide the flexibility of design and durability that Lovely Life Jewelry does while transforming an emergency alert device from utilitarian in appearance to appealing and fashionable health, safety and security aides.

U.S. Pat. No. 4,078,660 issued Mar. 14, 1978 to Lerro is for a medical alert bracelet for caring an emergency supply of the patient's medication comprising a bracelet strap and a blister package containing medicament form. The blister package is held in a bracelet strap, a hole is formed in the bracelet strap beneath the blister package for push-through it ejection of the medicament from the bracelet, and a closure is provided for closing the strap onto the wrist of the patient. A weakened line is positioned across the strap and is easily ruptured to remove the strap from the patient's wrist, and a locator notch is provided at the weakened line so that it is easily located, even in the dark. The invention also includes a method of making the medical alert bracelet.

U.S. Pat. No. 7,946,459 issued May 24, 2011 to Cheitman is a simple-to-use adornment device, and method, employed by a user close-at-hand for personal safety enhancement. It contains a personal alarm or remote control device while maintaining a capability for immediate alarm/remote activation to summon assistance. It has a jewelry appearance or comprises a modular casing to which exchangeable decorative elements can be attached. Since it improves the aesthetic look of an associated alarm/remote, users are more likely to wear it habitually and experience enhanced personal safety and well-being as a result thereof. Inner and outer members with asymmetrical keyed guides are in sliding relation to one another to form the casing with one way assembly, and a chord/chain connected to the members maintains their association with one another even when dissembled. Openings in each member or a line to provide activation button access. Optional features include an interior resilient spacer, a cover, a clasp, and a sheet pockets associated with the outer member.

U.S. Pat. No. 8,651,346 issued Feb. 18, 2014 to Williams provides a band for information storage includes an outer mold for attaching the band to a user's wrist, an external housing within the outer mold that includes a hollow upper portion for receiving a first removable component, wherein the first removal component is engraved with information about the user and/or includes an alarm alert or emergency call button; and an internal housing rotatably attached to the external housing and fitted therein for receiving a second removable component, wherein the second removal component includes a portable memory device.

U.S. Pat. No. 0,366,249 published Dec. 18, 2014 for West describes that an elasticized styled cover sleeve covers and transforms any of a variety of personal emergency help buttons into a clothing accessory. Interchangeable differently styled cover sleeves enable matching the style of the transformed clothing accessory to a style of clothing worn by a user. An emergency button pressing portion of the cover sleeve positioned over a personal help button flexes to allow pressing the help button through the cover sleep. Distinguishable decorative elements on the emergency button pressing portion reveal the location of the emergency button pressing portion and the personal help button beneath, when press, will summon help.

U.S. Pat. No. 2006/0,025,182 issued Feb. 2, 2006 to Tushinsky is an article for personal, vehicular or household use provides a visual alert for the presence of a mobile communication signal from a nearby but not physically connected communication device. The article includes a signaling assembly for providing a visual signal when a mobile communication signal is detected within a defined distance an antenna connected to the signaling assembly and extending from it. The signaling assembly may include a circuit module with and LED providing a visual signal when an adjacent mobile communication device is transmitting a signal within the defined distance. The defined distance is selected so as to make the article responsive only to signals from a mobile device within the users personal space.

U.S. Pat. No. 4,692,749 issued Sep. 8, 1987 to Bussing, provides a wearable alarm which can be in the form of a religious cross, jewelry or decorative article or the like normally found on the user's person, which, through simple sliding action, but achieves completion of a contained electrical circuitry and the energization of an audible signaling device. Entry to the operative components may be achieved in any manner, depending on the article in which the alarm is presented and, additionally, the audible alarm varied to provide a warning at any pre-selected distance from the wearer.

U.S. Pat. No. 5,420,570 (and U.S. Pat. No. 5,258,746), issued May 30, 1995 to Leitten, et al, describes a personal alarm which is compact, portable and fashionably design. In one embodiment, this personal alarm is structurally incorporate it into a wristwatch with the alarm components arranged thereon in a fanciful yet highly functional manner. This alarm may also be structurally incorporated into other conventional items such as a bracelet, pendant, necklace, keychain ornament, or any other conventional item which is often carried by the persons to be protected. In a further embodiment, the compact size is achieved without sacrificing intensity in the alarm signal by incorporating a specially wound autotransformer and and efficient switching device so as to provide a tuned warbling signal upon a piezo-electric transducer. Additionally, the alarm maybe activated or deactivated by manually actuating an actuator, such as a switch or plurality of switches, in a particular sequence.

A current need that is not being addressed in prior art is durable jewelry type adornment for emergency alert devices. Lovely Life Jewelry is not a clothing accessory, a wearable personal alarm or a container for keys and remote controls. It is not a medication delivery device. It is not a memory storage unit or a modular sliding casing box. This present patent is differentiated by the concept's function as ornamental jewelry to adorn all types of monitored emergency alert devices to provide a more palatable personal safety accessory. This jewelry is socially acceptable and attractive and, therefore, will increase the usage of the much-needed emergency alert devices.

BRIEF SUMMARY OF INVENTION

A primary objective of this present invention is to address the needs of the many who are aging into their retirement years, live alone or are at risk. A large number of these people refuse to habitually wear monitored emergency alert devices because the devices are unattractive in appearance. This present invention strives to increase the usage of these effective health, safety and security aides.

The objective overcomes the limitations of prior art by providing durable jewelry accessories specifically designed to enhance the appearance of monitored emergency alert devices. According to this invention, for example, fashion accessories, such as bracelets, brooches, necklaces, wrist watches, belt buckles or similar adornments could be adapted as Lovely Life Jewelry. These embodiments would not contain a wireless signal alerting device. Further, the alternative embodiments of these personal articles with various modifications and adaptations may be made within the scope of the spirit of the present invention. Back ground art has described an adornment device with inner and outer members with asymmetrical keyed guides sliding in relation to one another to form a protective case assembly over remote controlled device or personal alarm. This background art does not address the alert device avoidance problems by providing multiple attractive styles and design enclosure options with durable material construction as does this invention's Lovely Life Jewelry concept.

Prior art describes a wearable band including assessable memory and wearer information and call pendant. This background art does not make claims of a decorative appearance. Other background art describes a medical alert bracelet that dispenses medication, jewelry that contains electrical circuitry for an audible alarm or another that provides a tuned warbling signal upon a piezo-electric transducer. This present invention relates specifically to fashionably designed jewelry accessories adapted to enhance or constructed to improve the appearance of monitored emergency alert devices.

This present invention is not made of clothing materials nor is it a clothing accessory, rather it is ornamental jewelry adapted to monitored emergency alert devices to enhance the health, safety and security of the wearers.

BRIEF DESCRIPTION OF SEVERAL VIEWS OF EXAMPLE DRAWINGS

FIG. 1*a*: Front view example of the pendant design concept. The actual appearance of the jewelry may vary. FIG. 1A is the front elevation view of this example of the patent concept presenting a pendant jewelry configuration. This view shows a center button that allows the transfer of pressure by depressing onto the emergency alert device housed beneath. It is triangular in shape with filigreed edging. Illustrated is the jewel loop which a chain or other necklace could be threaded to create a pendant. The visible elements could be made of costume or designer materials excluding cloth and could be various styles.

Figure 1B:
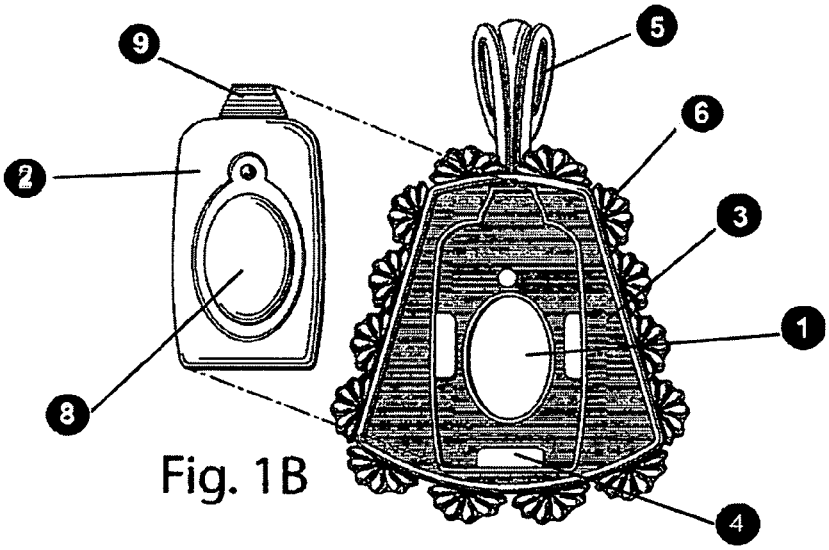

FIG. 1*b*: Rear view example of the pendant design concept which indicates how the emergency alert device could be inserted into the pendant. FIG. 1B is the rear elevation view of the example of the invention presented in a pendant costume or designer jewelry configuration. The drawing shows how the emergency alert device is inserted into the housing and held in place by retainer tabs on the sides and bottom of the housing. An emergency alert device is shown with the button that is positioned under the actuator button when the device is placed in the decorative housing. A loop is attached to the triangular jewelry configuration for a necklace to attach.

Figure 1C:
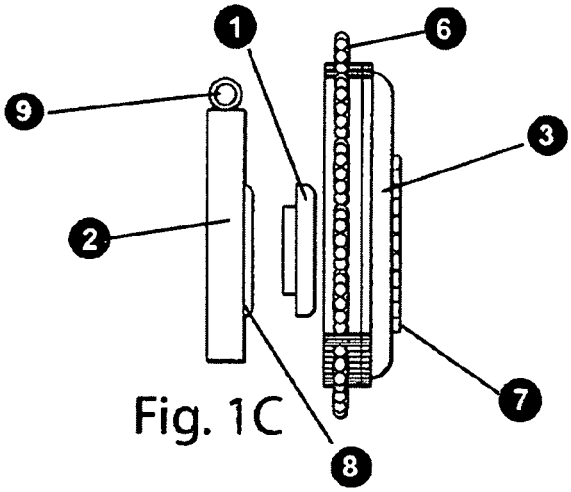

FIG. 1*c*: Side view of the pendant design concept which shows the use and placement of a custom designed actuator button to activate the alert device. Right and left side views are mirror images. FIG. 1C is the side elevation view of the example of the invention presented in the pendant jewelry configuration. The drawing shows an emergency alert device with the actuator button and the jewel housing.

Figure 2A:
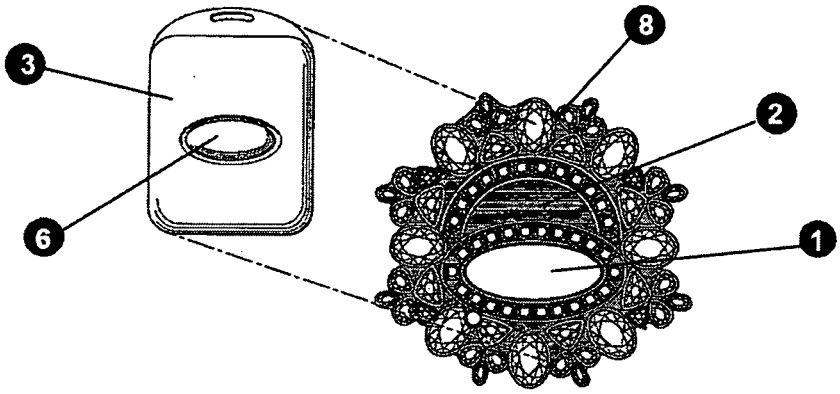

FIG. 2*a*: Front view example of the brooch design concept. The actual appearance of the jewelry pieces may vary. FIG. 2A is the front elevation view of the example of the costume or designer jewelry presented in this brooch type configuration. The center button allows transfer of pressure by depressing onto the activation button of the common type of emergency alert device housed beneath. This example appears in a circular type shape with either precious, semiprecious or artificial stones included in the design. Other costume or designer durable materials, excluding cloth, could be used in this example of brooch type jewelry.

Figure 2B:
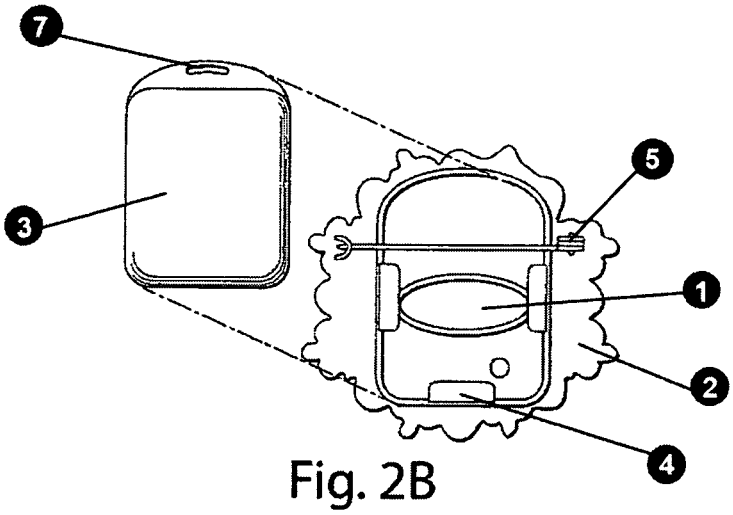

FIG. 2*b*: Rear view example of the brooch design concept which indicates how the emergency alert device can be inserted into the brooch. FIG. 2B is the rear elevation view of the example of the present invention in a brooch jewelry configuration. The drawing shows how an emergency alert device is inserted into the housing and held in place by retainer tabs on the side and at the bottom of the housing. A pin to attach the brooch to the wearer's clothing is noted.

Figure 2C:
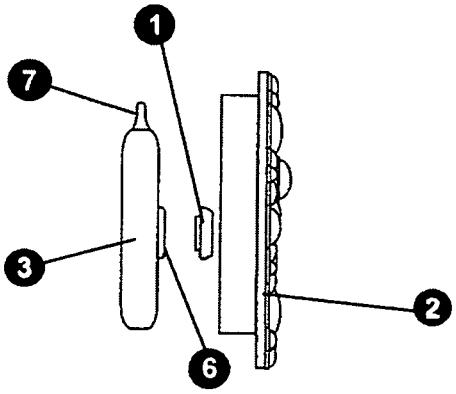

FIG. 2*c*: Side view of the brooch design concept which shows the use and placement of a custom designed actuator buttom to activate the alert device. Right and left side views are mirror images. FIG. 2C is the side elevation view presented in a brooch configuration. The drawing shows an emergency alert device and jeweled housing. The activation button is of the proper size to make this device compatible so as to depress and activate the attached emergency alert button and is shown above the alert device button.

Figure 3A:
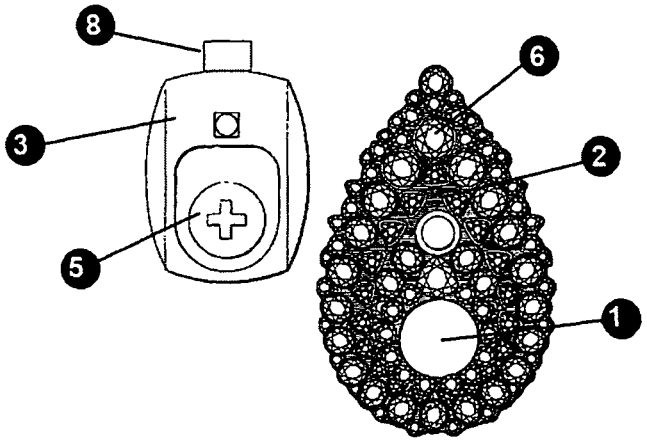

FIG. 3*a*: Front view example of the pendant/brooch design concept. The actual appearance of the jewelry pieces may vary. FIG. 3A is the front elevation view of the present invention pendant type jewelry configuration. This costume or designer decorative housing conceals a common emergency alert device. The button on the face of the jewelry will allow transfer of pressure and and engage the emergency alert device attached to the jewelry housing. The housing can use be made of costume, composite, designer or other durable materials.

Figure 3B:
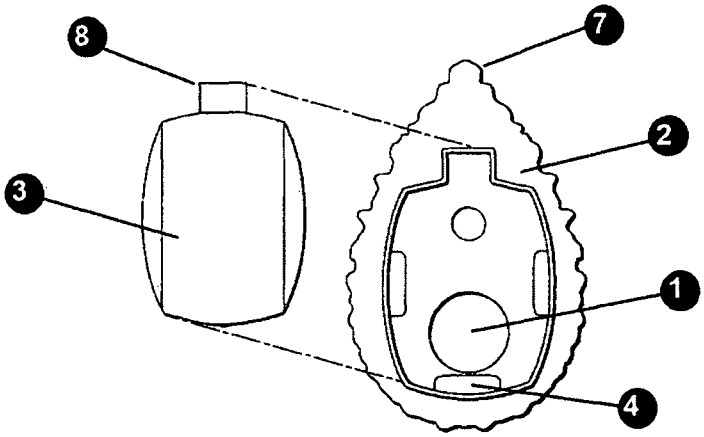

FIG. 3*b*: Rear view example of the pendant/brooch design concept which indicates how the emergency alert device could be inserted into the pendant/brooch. FIG. 3B is the rear elevation view of this example of the necklace pendant configuration which ornaments an emergency alert device. Any common emergency alert device such as one depicted in this view can be attached to this present invention. The emergency alert device is held in place by retainer tabs on the sides and bottom of the housing.

Figure 3C:
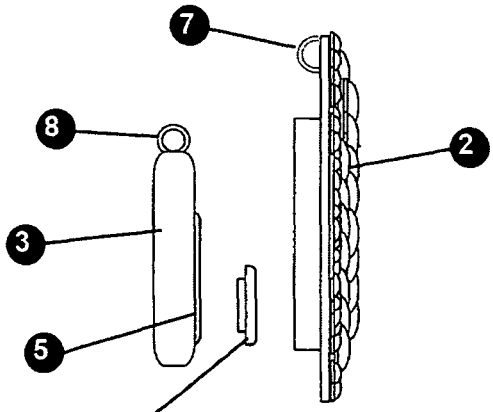

FIG. 3*c*: Side view of the pendant/brooch design concept which shows the use and placement of a custom designed actuator button to activate the alert device. Right and left side views are mirror images. FIG. 3C is the side elevation view of the present invention in a pendant jewelry configuration. This view shows a common emergency alert device, a actuary button and jewelry type housing.

Figure 4A:
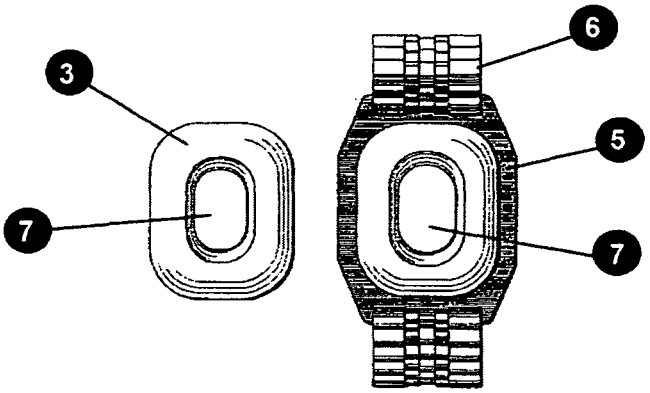

FIG. 4*a*: Front view example of the wrist band design concept. The actual appearance of the jewelry pieces may vary. FIG. 4A is the front elevation view of example of a wristband type configuration of this present invention. A variety of durable materials, including composites, could be used in the construction of this design. This wristband ornamentation houses a common emergency alert device. The watch type housing is open faced to allow access to the activation button on the attached common alert device. A lip in the front of this watch type design assist in holding the alert device in place.

Figure 4B:
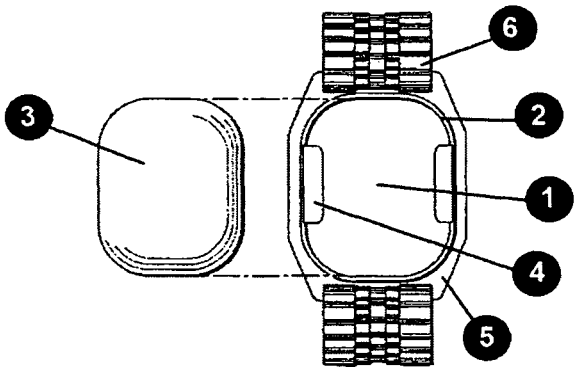

FIG. 4*b*: Rear view example of the wristband design concept which indicates how the emergency alert device could be inserted into the wristband. FIG. 4B is the rear elevation view of the present invention in a wristband configuration. The drawing shows a common emergency alert device that is inserted into the housing and held in place by a lip on the front and two retainer tabs on the rear.

Figure 4C:
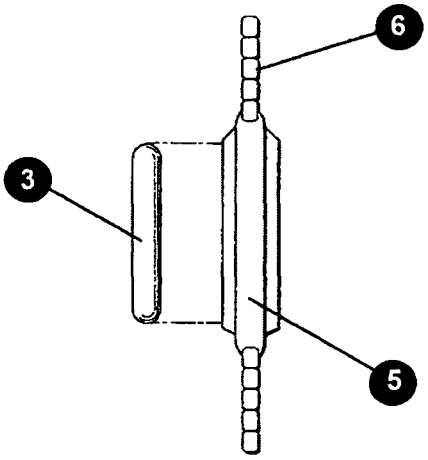

FIG. 4*c*: Side view of the wristband design concept which shows the use and placement of a custom designed actuator button to activate the alert device. Right and left side views are mirror images. FIG. 4C is the side elevation view of the current invention presented as example of a wristband configuration. The drawing shows a common emergency alert device, the housing and a wristband. A variety of durable materials could be used in construction such as composite, costume or designer products to transform this emergency alert device into an attractive ornamentation.

Figure 5A:
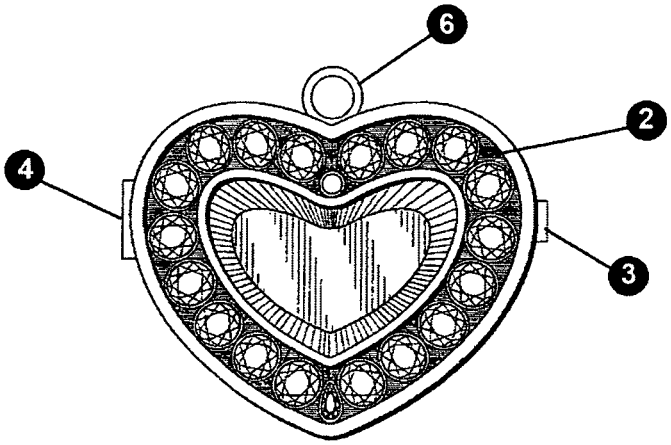

FIG. 5*a*: Front view example of the locket design concept. The actual appearance of the jewelry pieces vary. FIG. 5A is the front elevation view of this example of this present invention. It is presented in a locket configuration. The center button allows pressure to be applied to a button switch on the common circuit board for housing a common emergency alert device. This activator button and locket are attractive in appearance. The locket may be made in a variety of shapes and materials. This particular locket is in a heart shape and appears to be jeweled. The locket has a circular attachment at the top.

Figure 5B:
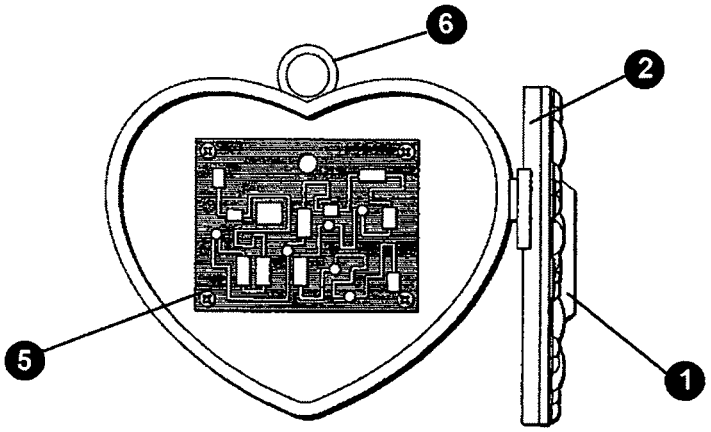

FIG. 5*b*: Open view example of the locket design concept which indicates how the emergency alert device circuitry could be inserted into the locket. FIG. 5B is the front elevation view of the present invention in a locket confirmation. The drawing shows the locket in an open position revealing generic internal emergency alert circuit components developed into a common emergency alert device. A hinge to close the locket is present. The locket could be a variety of designer or costume jewelry locket styles transforming the common emergency alert device into an attractive accessory.

Figure 5C:
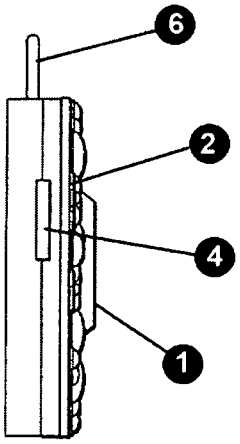

FIG. 5*c*: Side view of the pendant design concept which shows the use and placement of a custom designed actuator button to activate the alert device. Right and left side views are mirror images. FIG. 5C is the side elevation view of the present invention example. This is the side view of a locket configuration with the snap closure on the side. A side view of the loop attachment can be seen on the top of this drawing.

DETAILED DESCRIPTION OF THE INVENTION

FIG. 1A-5C show examples of styles of costume or designer jewelry that disguises and ornaments a variety of common emergency alert devices. These examples are Ornamental Enclosures for Emergency Alert Devices. These attractive accessories can be made from costume, designer, composite or similar materials. The jewelry could be adorned with costume or designer jewels or other decorations. They are not made of cloth and, therefore, are more durable.

FIGS. 1A, 1B and 1C are a pendant jewelry housing 3 and would be comprised of costume, designer, composite or similar durable materials. The housing 3 would disguise a common emergency alert device 2. Pendant filigree 6 and button filigree 7 are decorative and enhance the appearance of the jewelry disguising the alert device 2 making the device 2 more appealing in appearance. A button 1 would be sized appropriately to be depressed on the attached common alert device activation button 8. The alert device 2 would be attached to the housing by retainer tabs 4. The original loop attachment 9 would be encased in the the pendant jewelry housing 3 which positions the alert button 8 on the device 2 directly underneath the floating button 1 of the jewelry piece. The jewelry attachment loop 5 would be threaded with an attractive necklace or chain which could be worn by the user.

FIGS. 2A, 2B and 2C show an example of a brooch housing 2 that would transform a common emergency alert device 3 into an fashionable accessory capable of being used to summon assistance when the activation button 1 is depressed onto activation button 6 of the enclosed alert device 3. Costume or designer jewels 8 would decorate the housing 2 made from materials such as base or precious metals, plastics, composites, enamels, ceramics or similar materials in this example rendering. A variety of styles of common emergency alert devices 3 can be inserted into the jewelry such as depicted in this brooch jewelry housing 2. This common emergency alert device 3 has an original attachment slot 7. The alert device 3 would fit snugly beneath the activation button 1 that would depress the common alert device activation button 6. Retainer tabs 4 attach the monitored common emergency alert device 3 to the broach housing 2 and the pin 5 attaches the broach to the wearer's clothes.

FIGS. 3A, 3B and 3C depicts pendant jewelry housing 2 as another example of this concept patent invention which includes all types of costume and designer jewelry accommodating emergency alert devices 3. A compatibly sized button 1 is positioned over a common emergency alert device activation button 5 to summon help. An example material of a designer activation button 1 is mother-of-pearl. The jewels 6 may be costume or designer jewels. The costume or designer jewels 6 in this design can be made from glass, cubic zirconium, amethyst, rubies or chocolate diamonds or other products. This pendant design jewelry and other example jewelry designs are not made of clothing materials or as clothing and could be different styles and modified to encase, house or otherwise attach to various emergency alert devices. This view depicts retainer clips 4 to hold the device 3 in place. The attachment for a necklace 7 to this pendant jewelry housing 2 is in place for a decorative necklace rather than a cord that is generally used threading through the loop of an common emergency alert device 8.

FIGS. 4A, 4B and 4C are a wristband configuration example of the jewelry. The wristband's open face front 1 has a lipped edge 2 to hold an alert device 3 in place. The common emergency alert device 3 is also held in place by retaining tabs 4. The wristband housing 5 is held on the user's arm via a wristband 6. The common emergency alert device 3 is centered such that the common alert device activation button 7 can be depressed through the open faced front 1. The wristband configuration of the jewelry can be comprised of a variety of materials and in different styles.

FIGS. 5A, 5B and 5C picture a heart locket configuration of the jewelry. This is one example of the present invention's locket type design. The button activator 1 is centered over the emergency alert device which is depicted in this example with common emergency alert device internal circuitry 5 that can connect with future and existing emergency alert services. The locket housing 2 is closed with a locket hinge 3 and locket closure snap 4. The loop 6 can be attached to a necklace or bracelet.

What is claimed:

1. An ornamental enclosure and emergency alert device, comprising:

a removable housing having a front surface, a back surface, and a through hole, the front surface being ornamental, sidewalls surrounding the through hole extending from the back surface, the sidewalls having retainer tabs extending towards the through hole and are substantially parallel to and spaced from the back surface;

a button actuator placed within the through hole; and an alert device having an activation button on a front surface, and an opposite back surface, the alert device having sides complimentary in shape to the sidewalls to engage the sidewalls;

when the alert device is placed within the sidewalls, the activation button of the alert device is adjacent the button actuator, and the back surface of the alert device engages the retainer tabs.

2. The ornamental enclosure and emergency alert device of claim 1, wherein the removable housing comprises an attachment mechanism.

3. The ornamental enclosure and emergency alert device of claim 2, wherein the attachment mechanism is a loop configured to engage a necklace.

4. The ornamental enclosure and emergency alert device of claim 2, wherein the attachment mechanism is a pin configured to engage clothing.

* * * * *